United States Patent [19]

Cotton

[11] 3,976,903

[45] Aug. 24, 1976

[54] SLIP RING ASSEMBLY FOR A.C. MACHINES

[75] Inventor: Herbert John Thomas Cotton, Hollywood, England

[73] Assignee: The Lucas Electrical Company Limited, Birmingham, England

[22] Filed: Apr. 30, 1975

[21] Appl. No.: 573,261

[52] U.S. Cl. ..... 310/232; 339/8 R

[51] Int. Cl.[2] ..... H01R 39/08

[58] Field of Search ..... 339/5 R, 5 M, 6 R, 8 R; 310/232, 233, 239, 235, 236

[56] References Cited

UNITED STATES PATENTS

| | | | |
|---|---|---|---|
| 2,248,759 | 7/1941 | Hollander | 339/8 |
| 2,718,604 | 9/1955 | Herrick | 310/232 |
| 2,954,492 | 9/1960 | De Voe et al. | 339/8 R X |
| 3,265,914 | 8/1966 | Derber et al. | 310/232 |
| 3,636,394 | 1/1972 | Forste et al. | 310/239 |
| 3,842,301 | 10/1974 | Smith | 310/232 |

FOREIGN PATENTS OR APPLICATIONS 940,370 12/1948 France

*Primary Examiner*—Donovan F. Duggan
*Attorney, Agent, or Firm*—Olsen, Trexler, Wolters, Bushnell & Fosse, Ltd.

[57] ABSTRACT

A slip ring assembly for an a.c. machine comprises a pair of copper rings mounted on an electrically insulating sleeve formed of two arcuate portions, each of which extends for less than the true semi-circle so that the sleeve is not a true cylinder of circular cross-section. Means internally of the sleeve urges the arcuate portions outwardly when the sleeve is mounted on a rotor shaft of the a.c. machine so as to retain the rings in position on the sleeve. The means may be in the form of a separate, split cylindrical spring or in the form of a taper on the inner surface of the sleeve which engages a corresponding taper on the rotor shaft.

7 Claims, 5 Drawing Figures

SLIP RING ASSEMBLY FOR A.C. MACHINES

This invention relates to slip ring assemblies for a.c. machines, particularly but not exclusively alternators.

According to the present invention, there is provided a slip ring assembly for an a.c. machine, comprising a pair of electrically conducting rings mounted on an electrically insulating sleeve formed of a plurality of arcuate portions, and means internally of the sleeve urging the arcuate portions thereof outwardly so as to retain the rings in position on the sleeve.

In one embodiment, the said means is in the form of a taper on the inner surface of the sleeve, which taper is arranged to engage a corresponding taper on a rotor shaft of the machine when the assembly is mounted thereon in use.

In an alternative embodiment, the said means is in the form of a separate resilient member.

Preferably, the resilient member comprises a split cylindrical spring, the split cylindrical spring may be provided with at least one tang thereon, and the sleeve may have a detent in the inner surface thereof in which the or each tang engages. Conveniently, two tangs are provided, one at each end of the split cylindrical spring.

The resilient member may be provided with internal projections thereon to engage a rotor shaft of the machine when the assembly is mounted thereon in use.

Most preferably, the outer and inner surfaces of the sleeve are recessed to locate the rings and means, respectively.

Embodiments of the present invention will now be described, by way of example, with reference to the accompanying drawings, in which.

Figure 1:
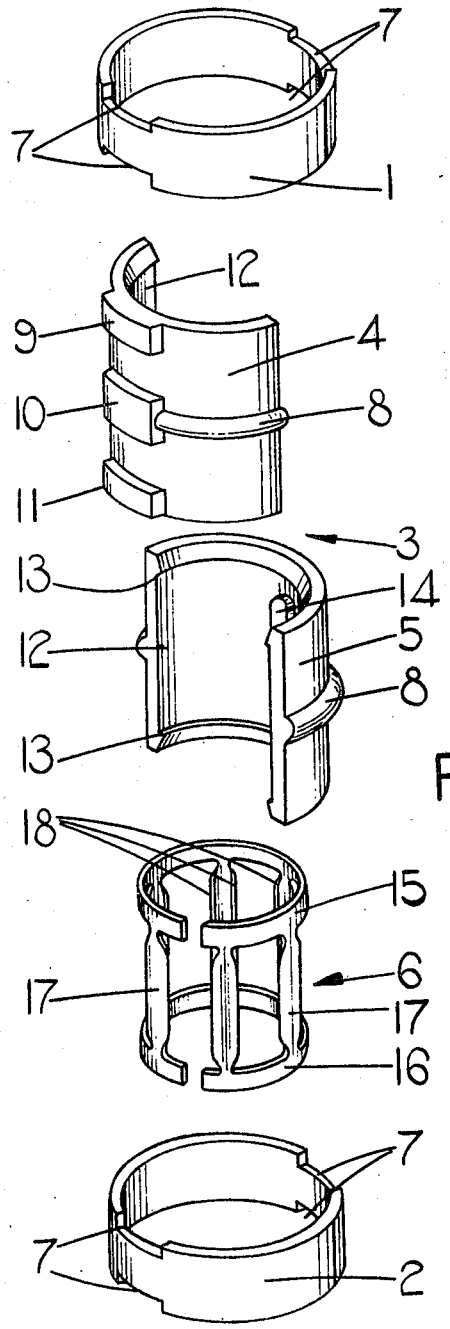
FIG. 1 is an exploded perspective view of one form of slip ring asssembly for an alternator, according to the present invention.

Referring to FIG. 1, one form of slip ring assembly comprises a pair of copper rings 1 and 2, a sleeve 3 formed of a pair of arcuate portions 4 and 5 and a split cylindrical spring 6.

Each copper ring 1, 2 has a series of four recesses 7 therein, there being two diametrically opposed recesses at each end of each ring 1, 2.

Each arcuate portion 4, 5 extends for slightly less than a true semi-circle so that, when placed together, the two arcuate portions 4 and 5 do not define a true cylinder having a circular cross-section. Each arcuate portion 4, 5 is moulded from an electrically insulating phenolic resin and has an integral arcuate rib 8 on its outer surface together with external integral projections 9, 10 and 11 and an internal recess 12 therein defining shoulders 13 at each end of the portion 4, 5. An internal, integral rib 14 is formed on each arcuate portion 4, 5.

The split cylindrical spring 6 is comprised by a pair of split rings 15 and 16 integrally united together by spacer ribs 17 which are of generally arcuate cross-section so that each spacer rib 17 defines a pair of internally facing, longitudinally extending gripping projections 18.

The above described components are assembled as follows.

First of all, the two arcuate portions 4 and 5 are brought together and the rings 1 and 2 are slid over the respective projections 9 and 11 so as to be located on the sleeve 3 and separated by the rib 8. The recesses 7 in the rings 1 and 2 co-operate with the projections 9, 10 and 11 on the arcuate portions 4 and 5. Then the split cylindrical spring 6 is radially compressed and inserted into the sleeve 3 and is then allowed to expand so as to be accommodated in the recesses 12 and abut at each end against the shoulders 13 of the arcuate portions 4 and 5. Furthermore, the ribs 14 on the portions 4 and 5 extend into the gaps between adjacent spacer ribs 17 on the spring 6. Due to radial expansion of the spring 6, the arcuate portions 4 and 5 of the sleeve 3 expand outwardly and so retain the rings 1 and 2 in position thereon.

When the above described slip ring assembly is mounted on the rotor shaft of an alternator, the inwardly directed gripping projections 18 on the spring 6 bite into the shaft and thus hold the slip ring assembly firmly in position. The insertion of the rotor shaft through the spring 6 further causes the arcuate portions 4 and 5 to be expanded outwardly and thus further locks the rings 1 and 2 in position.

Figure 2:
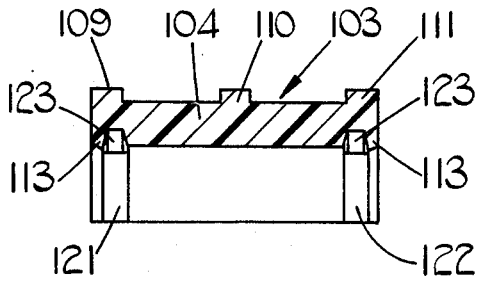
FIG. 2 is a longitudinal section through an arcuate portion forming part of a modified form of slip ring assembly, also according to the present invention.
Figure 3:
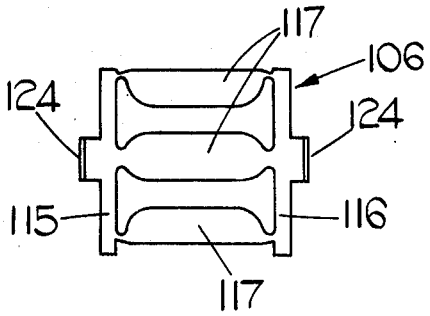
FIG. 3 is a side view of a split cylindrical spring forming a part of the said modified form of slip ring assembly.
Figure 4:
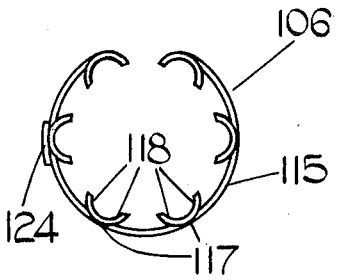
FIG. 4 is an end view of the spring of FIG. 3.

In FIGS. 2, 3 and 4 there are shown parts of a modified form of slip ring assembly, which is substantially identical to the slip ring assembly described above with reference to FIG. 1, and similar parts have been accorded the same reference numerals with 100 added.

However, the internal recess 12 and internal ribs 14 of the sleeve 3 in the embodiment of FIG. 1 are replaced in the embodiment of FIGS. 2, 3 and 4 by a pair of annular slots 121, 122, one adjacent each end of the sleeve 103, as is shown in relation to one of the arcuate portions 104 in FIG. 2. The slots 121, 122 define the shoulders 113 at each end of portion 104, and are adapted to receive the split rings 115, 116 respectively of the spring 106. The slots 121, 122 each have a detent 123 formed therein, which detents 123 are axially aligned. The spring 106 has a tang 124 integrally formed on each axial end thereof, the tang 124 being axially aligned and being adapted to fit into the respective detents 123.

The method of assembly is the same as that described above in relation to FIG. 1, *mutatis mutandis*, except that spring 106 is now held in position on the sleeve 103 by the engagement of the split rings 115, 116 in the slots 121, 122 respectively, and by the engagement of tangs 124 in the respective detents 123.

It is considered that the assembly of FIGS. 2, 3 and 4 provides better protection against the spring 106 coming out of the sleeve 103 when the assembly is being fitted to a rotor shaft of the a.c. machine.

Figure 5:
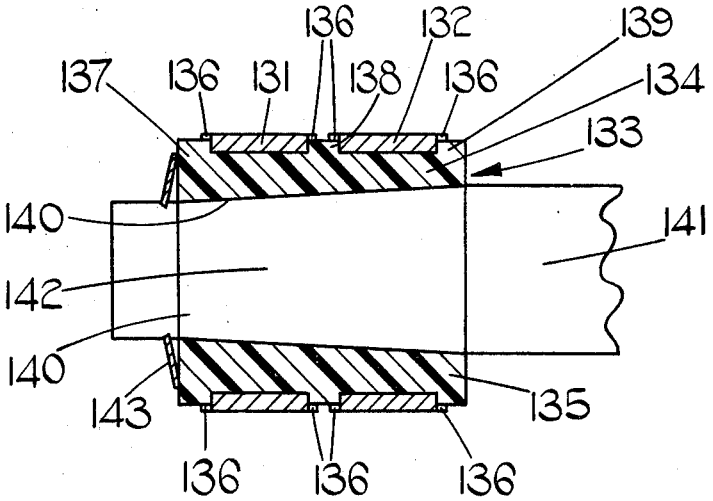
FIG. 5 is a lateral section through an alternative form of slip ring assembly according to the present invention, mounted on a rotor shaft.

Referring to FIG. 5, there is shown therein an alternative form of slip ring assembly comprising generally a pair of copper rings 131, 132 and a sleeve 133 formed by a pair of arcuate portions 134, 135. The copper rings 131, 132 are identical to the rings 1, 2 described above in relation to FIG. 1, being provided with a series of four recesses 136 therein which engage projections 137, 138 and 139 on the exterior of sleeve 133.

Each arcuate portion 134, 135 extends for less than a true semi-circle so that, when placed together, the two arcuate portions 134, 135 do not define a true cylinder having a circular cross-section. Each arcuate portion 134, 135 is moulded from an electrically insulating phenolic resin, and has a respective tapered inner surface 140.

The rings 131, 132 and arcuate portions 134, 135 are assembled and mounted on a shaft 141 of an a.c. machine (not shown) as follows.

First, the two arcuate portions 134 and 135 are brought together and the rings 131 and 132 are slid over the respective projections 137 and 139 so as to be located on the sleeve 133, with the recesses 136 in the rings 131 and 132 co-operating with the projections 137, 138 and 139 on the portions 134 and 135.

The sleeve 133 is then placed on the end of rotor shaft 141. The rotor shaft 141 has a tapered surface 142 which engages the tapered internal surface 140 of sleeve 133. Upon movement of the assembly to the right, as viewed in FIG. 5, the tapered surfaces 140 and 142 co-act to force the sleeve portions 134 and 135 apart. The sleeve 133 thus expands outwardly so as to retain the rings 131 and 132 in position thereon.

The assembly is held in position on shaft 141 by means of a spire clip 143. The slip 143 comprises a resilient, dished disc having a central aperture through which shaft 141 passes. A plurality of teeth extend radially inwardly from the edge of the central aperture and bite into the material of shaft 141. The clip 143 is arranged to have its concave face bearing against the sleeve 133, so that any tendency of the latter to ride along the shaft 141 to the left, as viewed in FIG. 5, is opposed by the teeth of clip 143 biting further into shaft 141.

It is considered that the above described assemblies are easier to manufacture than slip ring assemblies in wich copper rings have to be mounted extremely accurately within injection moulds before plastics material can be injected into the mould in order to produce the insulating sleeve to produce an assembly which has to be press-fitted onto the rotor shaft.

I claim:

1. A slip ring assembly for an a.c. machine, comprising an electrically insulating sleeve formed of a plurality of arcuate portions, a pair of electrically conducting rings mounted on said sleeve, and a separate resilient member internally of said sleeve urging said arcuate portions thereof outwardly so as to retain said rings in position on said sleeve.

2. The slip ring assembly according to claim 1, wherein said resilient member comprises a split cylindrical spring.

3. The slip ring assembly according to claim 2, wherein at least one tang is provided on said split cylindrical spring, and at least one detent is provided in the inner surface of said sleeve in which said at least one tang engages.

4. The slip ring assembly according to claim 3, wherein two tangs are provided, one at each end of said split cylindrical spring.

5. The slip ring assembly according to claim 4, wherein said two tangs are axially aligned.

6. The slip ring assembly according to claim 1, wherein internal projections are provided on said resilient member to engage a rotor shaft of said a.c. machine when said slip ring assembly is mounted thereon in use.

7. The slip ring assembly according to claim 1, wherein recesses are provided in the outer and inner surfaces of said sleeve to locate said rings and said resilient member, respectively.

* * * * *